United States Patent [19]

Spessert

[11] 4,057,233

[45] Nov. 8, 1977

[54] CONTINUOUS FURNACE

[75] Inventor: Robert Spessert, Bergisch Gladbach, Germany

[73] Assignee: "OFU" Ofenbau-Union GmbH, Dusseldorf, Germany

[21] Appl. No.: 703,503

[22] Filed: July 8, 1976

[30] Foreign Application Priority Data

July 10, 1975 Germany ..... 2530794

[51] Int. Cl.[2] ..... C21D 1/12

[52] U.S. Cl. ..... 266/252

[58] Field of Search ..... 266/249, 252, 261; 432/144, 146, 147, 153, 159, 175, 178, 249

[56] References Cited

U.S. PATENT DOCUMENTS

| | | | |
|---|---|---|---|
| 1,970,320 | 8/1934 | Kier et al. | 432/146 |
| 2,039,445 | 5/1936 | Parmelee | 432/153 |
| 2,883,175 | 4/1959 | Dailey et al. | 432/249 |

FOREIGN PATENT DOCUMENTS

| | | | |
|---|---|---|---|
| 1,079,602 | 5/1954 | France | 432/159 |

*Primary Examiner*—Gerald A. Dost

[57] ABSTRACT

A continuous furnace for metal slabs in which the side walls of the furnace each include a lower portion extending upwardly from the floor of the furnace and an upper portion extending from the lower portion to the roof of the furnace. The upper and lower portions are shaped so that tangents to the inner surface of the upper portion form an angle of at least 90° with respect to the upper planar surface of the slab while tangents to the inner surface of the lower portion form an obtuse angle with such planar surface to minimize the reflection of heat to the slab to the side walls.

8 Claims, 2 Drawing Figures

CONTINUOUS FURNACE

FIELD OF THE INVENTION

The invention relates to a continuous furnace for heating metal slabs or similar elongated objects in transverse position.

BACKGROUND

The heating of slabs or objects in such furnaces is not only achieved directly by means of roof burners and/or by the radiation of heat from the roof but also by means of radiation reflected from the side walls. It has been established that rolled strips from slabs which had been heated in such a furnace having vertical side walls have a different quality at the leading edge and the end of the strip as compared to that in the rest of the area of the strip. Such differences in quality are particularly undesired for transformer sheet steel, for example, experiments have shown that peak temperatures in the area of the ends of the slabs are responsible for this different quality of the strip over its length. This different heating is due to the radiation from the roof, which is reflected on the side walls of the furnace and which strikes the ends of the slabs, being most intensive thereat while its intensity decreases towards the middle of the slab such that it becomes negligibly small thereat in comparison to the direct radiation prevailing there.

In order to prevent this disproportionate heating of the slabs, attempts have been made to provide niches in the side walls in the area of the conveying paths of the ends of the slabs, which niches protect the ends of the slabs against the radiation heat of the furnace walls. Such a furnace has certain structural difficulties due to the presence of the niches.

SUMMARY OF THE INVENTION

An object of the invention is to provide a continuous furnace of the above mentioned type in which an undesirably intense heating of the ends of objects does not arise with a simple structural embodiment.

This object is achieved by a construction wherein at least over a part of the whole length of the furnace, especially in the soaking part thereof, tangents placed on the inner surfaces of the side walls above the plane of the slabs form, with respect to the slab plane, a right or obtuse angle in the area of the side wall remote from the slabs and an obtuse angle in the area of the side wall close to the slabs.

If the furnace has lower heating in addition to the upper heating, it is proposed that at least over a part of the whole length of the furnace, especially in the heating-zone, the tangents to the inner surfaces of the side walls below the plane of the slabs form, with respect to the slab plane, a right or obtuse angle in the area remote from the slabs and an obtuse angle in the area close to the slabs.

The ends of the slabs in the furnace, according to the invention, are no longer protected against radiation from the walls by screening elements. The radiation from the roof reflected by the side walls of the furnace is, on the contrary, deflected by the shaping of the furnace walls in such a way that it no longer strikes the slab ends, or only partly strikes the ends or is distributed over a large area on the slab, so that the proportion of heating of the ends of the slab as a consequence of the reflected radiation, no longer leads to overheating of said ends of the slab. As the decrease in intensity of the radiation is achieved by suitable inclination of the furnace walls and not by means of niches, such a furnace may be constructed without any structural difficulties.

The side walls are preferably concave towards the inside of the furnace, and in particular are curved in the form of a circular arc. Alternatively, the area of the wall remote from the slabs may be flat and inclined, and the area of the wall close to the slabs curved concavely, in particular in the form of a circular arc. Both wall areas preferably merge tangentially with one another.

It can be achieved by means of the choice of the radius of curvature of the concavely curved side walls or wall areas, and by means of the inclination of the flat wall area remote from the slab and also by means of the inclination of the wall area close to the slab that the radiation issuing from specific areas, in particular from the central roof area which begins at a defined distance from the side walls, and reflected from the walls does not strike the slab ends, or only strikes the slab over a distributed area.

Since the radiation from the roof, which is reflected from the side walls of the furnace and which still contributes to heating of the ends of the object, issues from the roof area between the side wall and the aforementioned central roof area, the side areas of the roof can be recessed with respect to the rest of the roof of the furnace to decrease the intensity of the radiation. By so doing, the intensity of the source of radiation is decreased and with it the reflected radiation.

It is evident that the curvature of the side wall need not extend constantly. The inner surfaces of the side walls can also be formed from successive flat portions forming a polygonal outline.

BRIEF DESCRIPTION OF THE DRAWING

The invention is described in greater detail with reference to the attached drawing the figures of which schematically show one-half of furnaces in cross-section in an area where only upper heating is provided, i.e. a soak area. If lower heating is also provided, e.g. in the heating zone, the side wall below the slab plane can be constructed similarly to the side wall above the slab plane, namely in a mirror image thereof.

DETAILED DESCRIPTION

Figure 1:
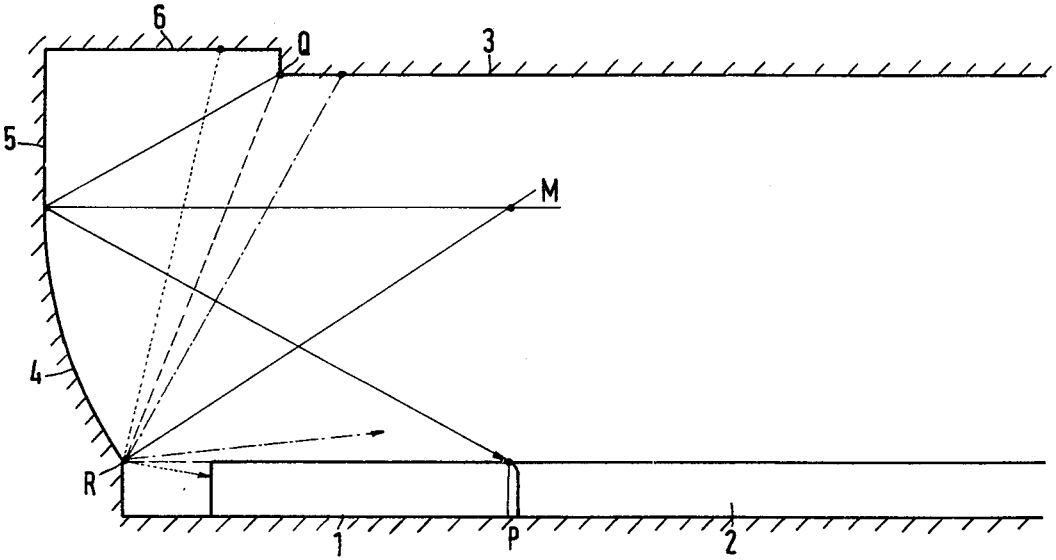

According to FIG. 1 elongated objects 2, such as slabs, are transported on a furnace floor 1 transversally. Roof burners (not shown) are arranged in a central roof area 3 which extends to point Q. A side roof area 6, which extends from point Q to the wall 4, 5 is recessed with respect to the central roof area 3. The wall area 5 remote from the slabs 2 is vertical, whereas the wall area 4, close to the slabs 2, which merges tangentially with wall area 5, is formed to be concave relative to the interior of the furnace. The area 4 is preferably in the form of a circular arc. The concave wall area 4 extends downwards to the upper plane of said slabs 2. The inclination of said wall area 4 relative to the plane of said slabs 2 is chosen so that tangents to the surface of this wall area include an obtuse angle with the slab plane. Due to the conformation of the wall area 4, the radiation which is issued by said roof areas 3, 6 and reflected on the wall areas 4, 5, strikes said slab 2 with decreased intensity. The radiation issuing from roof area 3, which is more intensely heated in comparison to area 6, and reflected by said wall areas 4 and 5, does not strike the end area of said slab 2 (which is the area to the left of point P) but only strikes the area of said slab 2 to the right thereof. The less intensive radiation issuing from the recessed and thereby less intensely heated roof area 6 strikes the end area of said slab 2 to the left of point P. The radiation striking the end of the slab is reduced due to the recessing of area 6 and by reason of the fact that the reflection from the wall includes an obtuse angle with the slab plane such that said radiation does not lead to an over-intensive heating of the ends of said slab 2 with respect to the heating of the middle area of the slab.

The height of the flat wall area and the radius of curvature of the curved wall area are chosen to provide a predetermined clear height of the furnace, a predetermined clear width of the furnace in the roof and floor areas and for predetermined ends of slabs, i.e. with predetermined point P relative to R, so that the requirement is fulfilled, considering the laws of reflection, that the roof radiation from a defined space of the side walls to the middle of the furnace, i.e. the radiation issuing from a central roof area and reflected on the side walls, does not strike the ends of the slab. In so doing, the height of the flat wall area and the radius of curvature of the curved wall area are chosen so that the width of the roof areas lying between the central roof area and the side walls is as small as possible.

Rays of radiation issuing from various points in the roof and reflected at point R are represented by dotted, dash-dot-dash or broken lines in the drawing. The ray issuing from point Q and reflected at the transition point of the vertical wall area and the wall area curved in the form of the circular arc hits the end of the slab at point P. As the ray indicated by the dash-dot-dash line issuing to the right of point Q shows, the reflected radiation from the central roof area no longer hits the slab end.

In the simplest embodiment, the side wall 4, 5 may also be constantly inclined, in particular flat. It is also possible for the area 4 to be concavely curved and the remote area 5 not to be vertical, as shown in the illustrated embodiment, but to be inclined.

Figure 2:
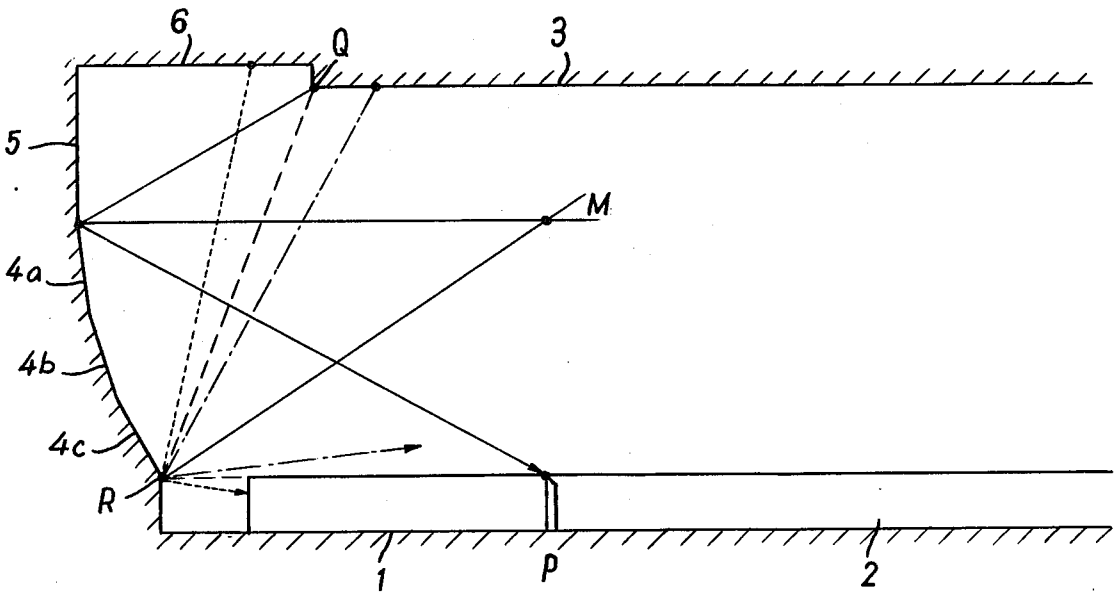

According to FIG. 2 the side wall of the furnace consists of portions 4*a*, 4*b*, 4*c*, 5 angularly connected to each other in such a way that the average angle of said portions relative to a horizontal plane increases from the lowest portion to the uppermost portion. So the portions form a polygonal course. Each of said portions may be flat or concavely curved.

What is claimed is:

1. A continuous furnace for metal elongated objects arranged in transversely extending disposition for travel along a plane through the furnace, said furnace comprising a chamber including inner side walls and a heating surface arranged in spaced relation with respect to the transport plane of the objects for directing heat radiation theretowards to heat said objects, said side walls including a first region closer to the transport plane concave inwards in shape and forming an angle with said transport plane or more than 90° as measured from the transport plane to said first region, said side walls including a second region further from the transport plane shaped to form an angle with said transport plane of at least 90° as measured from the transport plane to said second region, said side walls receiving heat radiation from said heating surface and due to the shape of said side walls the reflection of heat to said objects at the ends thereof proximate the side walls is minimized.

2. A continuous furnace for metal objects as claimed in claim 1 wherein said second region is flat.

3. A continuous furnace for metal objects as claimed in claim 1 wherein said first region is curved.

4. A continuous furnace for metal objects as claimed in claim 3 wherein said first region is curved along a circular arc.

5. A continuous furnace for metal objects as claimed in claim 3 wherein said second region merges tangentially with said first region.

6. A continuous furnace for metal objects as claimed in claim 1 wherein said furnace comprises a roof which includes a central portion and side portions connected to the side walls, said side portions of the roof being recessed with respect to the central portion.

7. A continuous furnace for metal objects as claimed in claim 1 wherein the inner surfaces of each of said side walls consist of several portions forming a polygonal course.

8. A continuous furnace as claimed in claim 1 wherein said heating surface extends parallel to said transport plane and directs radiation generally normal thereto.

* * * * *